US008496013B2

(12) United States Patent
McCourtney

(10) Patent No.: US 8,496,013 B2
(45) Date of Patent: Jul. 30, 2013

(54) NAIL CLIPPER HOLDING DEVICE

(76) Inventor: Shawn McCourtney, Woodstock, GA (US)

( * ) Notice: Subject to any disclaimer, the term of this patent is extended or adjusted under 35 U.S.C. 154(b) by 0 days.

(21) Appl. No.: 13/011,804

(22) Filed: Jan. 21, 2011

(65) Prior Publication Data

US 2012/0204891 A1 Aug. 16, 2012

Related U.S. Application Data

(60) Provisional application No. 61/306,773, filed on Feb. 22, 2010.

(51) Int. Cl.

| | |
|---|---|
| ***A45D 29/20*** | (2006.01) |
| ***A45D 29/18*** | (2006.01) |
| ***A45D 29/05*** | (2006.01) |
| ***A45D 29/00*** | (2006.01) |
| ***B26B 13/22*** | (2006.01) |
| ***B26B 17/00*** | (2006.01) |
| ***B25B 1/00*** | (2006.01) |

(52) U.S. Cl.

USPC ..... 132/75; 132/73.5; 132/73.6; 132/75.4; 132/75.5; 30/28; 269/3

(58) Field of Classification Search

USPC ..... 132/75, 73, 73.5, 73.6, 75.3, 75.4, 132/75.5, 75.8, 76.2, 286, 288, 333, 200; 206/581, 823, 238, 235, 37, 38, 216; 220/661, 220/601; D28/56, 57, 58, 60; 30/26–29, 124, 30/125, 143, 145, 131, 175; 119/610; 269/11, 269/16, 289 R, 3, 6

See application file for complete search history.

(56) References Cited

U.S. PATENT DOCUMENTS

| | | | | | |
|---|---|---|---|---|---|
| 3,943,948 | A | * | 3/1976 | Sartore | 132/73 |
| 4,150,481 | A | * | 4/1979 | Min | 30/28 |
| 4,341,015 | A | * | 7/1982 | Young | 30/28 |
| 4,412,618 | A | * | 11/1983 | La Conte | 206/581 |
| 4,550,496 | A | * | 11/1985 | Reinicke | 30/124 |
| 4,564,034 | A | * | 1/1986 | Mackel | 132/73 |
| 4,574,475 | A | * | 3/1986 | Lee | 30/28 |
| 4,577,754 | A | * | 3/1986 | Jones | 206/349 |
| 4,602,430 | A | * | 7/1986 | Allen, Jr. | 30/28 |
| 4,648,415 | A | * | 3/1987 | Yuan | 132/73 |
| 4,788,768 | A | * | 12/1988 | Ohori | 30/28 |
| 4,854,334 | A | * | 8/1989 | Su | 132/73.6 |
| 4,940,136 | A | * | 7/1990 | Miller et al. | 206/38.1 |
| 4,984,366 | A | * | 1/1991 | Powers | 30/124 |
| 5,046,606 | A | * | 9/1991 | Morelli | 206/37 |
| 5,117,847 | A | * | 6/1992 | May | 132/75.5 |
| 5,123,430 | A | * | 6/1992 | Davidovitz | 132/75.8 |
| 5,150,521 | A | * | 9/1992 | Han | 30/28 |
| D339,656 | S | * | 9/1993 | Paladino et al. | D28/56 |
| D345,628 | S | * | 3/1994 | Pacio | D28/60 |

(Continued)

*Primary Examiner* — Vanitha Elgart
(74) *Attorney, Agent, or Firm* — Rodgers & Rodgers

(57) ABSTRACT

A fingernail clipper holding device includes a housing having a hollow interior and having a generally ellipsoid ergonomic configuration that is easy to grip. An upper portion of the housing may include a channel having a configuration to receive the housing of a fingernail clipping device and to hold it securely. The housing defines a receiving area on which a user may position his finger adjacent the cutting head of the fingernail clipping device. A gripping member is attached to a lower portion of the housing to receive a user's fingers or hand. Stabilizing members may be attached to the bottom surface of the lower portion to hold the housing stationary on a flat surface.

14 Claims, 9 Drawing Sheets

U.S. PATENT DOCUMENTS

| | | | | | |
|---|---|---|---|---|---|
| D353,687 | S | * | 12/1994 | Dacko | D28/60 |
| 5,423,124 | A | * | 6/1995 | Marrocco | 30/28 |
| 5,490,327 | A | * | 2/1996 | Ohori | 30/28 |
| 5,524,344 | A | * | 6/1996 | Bazal | 30/28 |
| 5,546,658 | A | * | 8/1996 | MacLeod et al. | 30/28 |
| 5,570,509 | A | * | 11/1996 | Killian | 30/28 |
| 5,622,191 | A | * | 4/1997 | McMullen et al. | 132/75.5 |
| 5,632,288 | A | * | 5/1997 | Webb | 132/75.5 |
| D403,116 | S | * | 12/1998 | Ross | D28/60 |
| D403,118 | S | * | 12/1998 | Farrell et al. | D28/60 |
| 5,870,826 | A | * | 2/1999 | Lewan | 30/28 |
| 5,881,735 | A | * | 3/1999 | Kutnik | 132/75.4 |
| 5,931,167 | A | * | 8/1999 | Coleman | 132/73.5 |
| 6,035,860 | A | * | 3/2000 | Mombourquette | 132/200 |
| 6,088,919 | A | * | 7/2000 | Gilman | 30/28 |
| 6,138,360 | A | * | 10/2000 | Owens et al. | 30/28 |
| 6,220,251 | B1 | * | 4/2001 | Jeong et al. | 132/73.5 |
| 7,024,774 | B2 | * | 4/2006 | Novellie et al. | 30/28 |
| 7,159,318 | B1 | * | 1/2007 | Farag | 30/28 |
| 7,222,427 | B1 | * | 5/2007 | Kaidi et al. | 30/28 |
| 7,263,775 | B2 | * | 9/2007 | Moulton, III | 30/29 |
| D625,884 | S | * | 10/2010 | Ashok et al. | D28/60 |
| 7,954,242 | B1 | * | 6/2011 | Brizan | 30/28 |
| 8,096,305 | B1 | * | 1/2012 | Cheney | 132/73.5 |
| 2004/0194795 | A1 | * | 10/2004 | Cho | 132/73 |
| 2006/0180169 | A1 | * | 8/2006 | Lund et al. | 132/73.5 |
| 2007/0028936 | A1 | * | 2/2007 | Kriser | 132/76.4 |
| 2008/0148572 | A1 | * | 6/2008 | Samson | 30/28 |
| 2009/0223055 | A1 | * | 9/2009 | Wendorf et al. | 30/28 |
| 2009/0229622 | A1 | * | 9/2009 | Malin et al. | 132/73.5 |
| 2010/0050438 | A1 | * | 3/2010 | Yip | 30/28 |
| 2011/0005537 | A1 | * | 1/2011 | Hsu | 132/73.5 |
| 2011/0061239 | A1 | * | 3/2011 | Pacio | 30/28 |
| 2011/0226270 | A1 | * | 9/2011 | Rivera | 132/73.6 |

* cited by examiner

NAIL CLIPPER HOLDING DEVICE

CROSS-REFERENCE TO RELATED APPLICATIONS

The present utility patent application claims the advantage of provisional application No. 61/306,773, filed Feb. 22, 2010.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to nail clippers and particularly to a nail clipper holding device includes a housing comprising a body having a hollow interior for holding nail clippings and having a generally ellipsoid configuration that is easy to grip, a channel in an upper portion of the housing having a configuration suitable to receive the base of a nail clipping device to hold it securely, a receiving area on which a user may position his finger adjacent the cutting head of the fingernail clipping device, a gripping member attached to a lower portion of the housing to receive a user's fingers or hand, and stabilizing members which may be attached to the bottom surface of the lower portion to hold the housing stationary on a flat surface.

2. Description of Related Art including information disclosed under 37 CFR 1.97 and 1.98

It is sometimes difficult for a person to maintain an effective grip on traditional nail clippers while attempting to trim one's own nails or those of another person. A lack of grip on nail clippers may be because a lack of dexterity by a person's fingers, the small and awkward size of traditional clippers, or the slippery texture of the metal construction. As a result, the lack of grip may result in dropping the clippers, cutting a fingernail too deeply, or being unable to cut completely through a thick fingernail or toenail.

Various devices have been proposed in the prior art for enhancing the grip of a fingernail clipping device. Although assumedly effective for their intended purposes, the existing devices are not easily adaptable to be held by a user, to be stationed on a flat surface, to secure multiple types or sizes of clippers, or for collecting fingernail clippings.

U.S. Pat. No. 5,546,658, issued Aug. 20, 1996 to MacLeod et al, indicates a nail clipping and collecting device for use with a conventional nail clipper designed to be easily grasped and manipulated, particularly by persons with reduced or impaired manual dexterity. A conventional nail clipper is removably positioned within a base and within a handle of the device which are removably hingedly connected together, and the base is configured for receiving, storing and emptying nail clippings. The handle is configured for removably storing a nail file, and a magnifying lens is adjustably connected to the handle for positioning to magnify a nail to be cut.

U.S. Pat. No. D403,116, issued Dec. 22, 1998 to Ross, puts forth the ornamental design for a combination nail clipper and cover therefor.

U.S. Pat. No. D4,956,915, issued Sep. 18, 1990 to Anderson, is for a sanitary nail clipping device for fingernails and toenails which includes an enclosure having an open side facilitating insertion of a nail-carrying digital member, and having a nail clipper aperture therethrough on its opposite side from the open side. The enclosure has a transparent top panel having a portion configured as a magnifying lens. A retention element is secured to the inside of the enclosure at a location adjacent the nail clipper aperture. The nail clipper has a portion thereof carrying clipper jaws extended through the aperture into the enclosure, and there detachably engaged by the retainer element.

U.S. Pat. No. 3,943,948, issued Mar. 16, 1976 to Sartore, illustrates a case with closeable lid comprised of a generally longitudinally tubular portion in which a nail clip can be inserted therein. Conforming to the same general outline of the nail clip which it houses and shell-like in appearance to it. Having internal pressure catches to captively hold the nail clip in place. With provision in its top wall to allow for the free movement of the operating handle and provision for a file, placed on a transverse to the longitudinal portion. Also containing a closeable and sealable front lid.

U.S. Pat. No. 4,602,430, issued Jul. 29, 1986 to Allen, Jr., provides a nail clipper handle and clipping catcher receptacle for a nail clipper of the lever action type. A resilient body member defines a slot into which the clipper can be inserted and retained by a depression formed in the bottom of the slot. The clipper is retained also by flanges and cavities within the body member. Large inner cavities extend within the body member on both sides of the clipper to receive and retain clippings sheared by the clipper. Such clippings can be disposed by removing the clipper and inverting the body member.

U.S. Pat. No. D307,195, issued Apr. 10, 1990 to Suppes, shows the ornamental design for a finger nail receptacle.

U.S. Pat. No. D562,499, issued Feb. 19, 2008 to Park, claims the ornamental design for a nail clipper.

U.S. Pat. No. 5,632,288, issued May 27, 1997 to Webb, describes a catcher for nail clippings shaped to slip onto a standard nail clipper. The catcher is made of a resilient material having laterally projecting cells for receiving the clippings. The catcher is designed to allow convenient collection and disposal of the clippings while ensuring compatibility with commonly possessed nail clippers. Such a design incorporates a slit made substantially along the body of each of the projecting cells for quick and efficient disposal of the stored nail clippings.

U.S. Pat. No. 5,150,521, issued Sep. 29, 1992 to Han, discloses a nail collection box for a nail clipper, including a nail collecting portion having a cylindrical configuration includes a handle portion integral with the collecting portion having a hollow space for receiving the body of the nail clipper and an engaging protrusion disposed at the rear end portion thereof to be engaged with a locking hole of the body of the clipper, and a separate concave collector for easily engaging with and disengaged from the collecting portion, whereby the nail collection box can effectively collect clipped nail fragments and prevent the collected nail fragments from scattering.

U.S. Pat. No. D361,865, issued Aug. 29, 1995 to Tosolt, puts forth the ornamental design for a nail clipper and support.

U.S. Pat. No. D546,502, issued Jul. 10, 2007 to Lund et al, is for the ornamental design for the combined nail clipper and holder.

U.S. Pat. No. 4,564,034, issued Jan. 14, 1986 to Mackel, provides a nail clipper holder which permits a conventional nail clipper to be operated with only a downward press of one finger or one toe, with the hand or foot having the nail to be cut resting on a common surface with the holder. The clipper butt end instantly slips into a socket in the block-like base of the holder, and is as quickly removed; a portion of the clipper with the jaws protrudes upwardly and forwardly beyond the holder and the socket has an incline downwardly toward the rear that tips the jaws upward for safe visibility and for increasing the securance of the clipper in the socket under pressure of nail cutting.

U.S. Pat. No. 7,159,595, issued Jan. 9, 2007 to Cho, shows a padded receiving device for nail care devices comprising a pad, a pad holder with a pad, or a padded base engaging case, individually or in any combination with each other. The pad holder for supporting the pad has a front slit and an optional rear slit. The pad holder has a top member and a bottom member molded or attached together. A hook from a rear end of the bottom member attaches the pad holder to the nail care device. The pad has a top piece and a bottom piece joined together by a center piece. The center piece situates at an opening bored on the nail care device. The padded receiving device may consist of the pad independent of the pad holder. If the nail care device has a base, the padded receiving device further comprises a padded base engaging case.

U.S. Pat. No. 6,523,545, issued Feb. 25, 2003 to Rende, claims a device for retaining nail clippings within a nail clipper which includes a housing adapted to cover the openings between the clippers elongate members, on both sides, from the first ends to the second ends thereof, thereby forming an enclosed region within the nail clipper. In addition, the device includes a valve element, adapted to be located between the elongate members, for blocking the passage of the nail clippings from the region of the jaw to the tail of the nail clipper when the jaw is opened and for allowing passage of the nail clippings when the jaw is closed. This allows nail clippings to pass to the region between the elongate members when the nails are being clipped and thereafter to be retained in this region when the jaw is opened. Thus, in effect, the valve works as a one way valve, permitting passage of the nail clippings into, but not out of, the nail clipper.

U.S. Pat. No. 5,870,826, issued Feb. 16, 1999 to Lewan, describes a nail clipper gripping aid. The aid comprises a channel including a central web and flanges extending in a first direction, the channel is formed with a fin extending in a second direction opposite the first direction. The fin has at least one finger opening therein. The usual nail clipper is mounted in the channel with the operating lever extending away from the aid so that it is readily operable.

U.S. Pat. No. 5,052,416, issued Oct. 1, 1991 to Rommerdale, discloses control improving components for fingernail clippers which incorporate finger/thumb receiving and holding zones constructed mounted directly to conventional implements, such as manicure implements, for use and access by individuals with reduced or impaired manual dexterity. Preferably, each control improving and enhancing system is constructed for being quickly and easily securely mounted to existing implements and may be removable therefrom for use on other implements. In addition, each control improving and enhancing system is constructed with enlarged, specially constructed, readily accessible, easily employable finger/thumb receiving and supporting zones which are positioned to assure complete operational control of the implement, thereby enabling individuals with reduced or impaired manual dexterity, or with varying stages of joint diseases, such as arthritis, to naturally and confidently use the implements.

U.S. Pat. No. 5,490,327, issued Feb. 13, 1996 to Ohori, concerns a plastic retainer for a nail clipper. The retainer is of skeletal construction and sized to receive a nail clipper. The side walls of the retainer receive the nail clipper in friction fit manner and define a chamber to receive nail clippings. In addition, the forward end of the nail clipper is received in a recessed position with the jaws of the nail clipper behind a front wall of the retainer. The forward end of the nail clipper can be moved to a raised operating position with the jaws of the nail clipper above the front wall and in an exposed position for nail cutting purposes. Projections are provided on the retainer at the forward end to prevent the forward end of the nail clipper from moving out of the retainer when being raised into the raised operating position.

Two U.S. Pat. Nos. 3,855,698 issued Dec. 24, 1974 and 3,903,596 issued Sep. 9, 1975 to Crosby, indicate an ecology nail-clip reservoir device for enclosing a nail clip and enclosing case operable in the closed state of the case having a case reservoir structure for the clipped nails. The clipping lever is enclosed with an exposed lever-end accessible for applying finger pressure thereto to close the clipper blades, and the casing structure providing a concavely shaped aperture following the opposing blades providing access to finger ends carrying nails to be clipped, the enclosure being openable for emptying collected clippings therefrom.

U.S. Pat. No. 3,180,025, issued Apr. 27, 1965 to Tsunemi, concerns a combined nail clipper and clippings receptacle.

U.S. Patent Application #20090223055, published Sep. 10, 2009 by Wendorf et al, is for a nail clipping apparatus for cutting a fingernail, thumbnail, or toenail nail of a user, comprising a base having an upstanding support member and a nail clipper disposed on the support member, wherein the nail clipper has a rotatable cutter head actuated to cut the user's nail by pivoting movement of a lower clipper arm upwardly toward and an upper clipper arm on which the cutter head resides, wherein the upper clipper arm is connected to the support member and wherein the lower clipper arm is connected to an actuating member that extends in front of the cutter head were a nail positioning pad is disposed on the actuating member adjacent the cutter head and where a user pushes downwardly on the actuating member to move the lower clipper arm upwardly toward the upper clipper arm to actuate the cutter head to cut a nail positioned in the cutter head.

U.S. Patent Application #20090119922, published May 14, 2009 by Doyle et al, provides an electrically powered, self-operated, hands-free, fingernail clipper for persons having neither the strength nor the flexibility to use a conventional leaf-spring type nail clipper. The unit is mounted in a PVC housing, with an aluminum cover, and consists of an electric, 3 RPM Hi-Torque motor, mounted on the side of a chassis strut, with a direct shaft drive to a Tri-Lobe cam that depresses the activating lever of a pair of conventional, leaf-spring type nail clippers. The motor is activated by a rocker switch, applying power through a cable plugged into normal house current (115-120V).

U.S. Patent Application #20080148572, published Jun. 26, 2008 by Samson, shows a nail clipper which can be used by a person having only one hand. The nail clipper comprises a base shaped to rest on a horizontal surface and an elongate actuator pivotably connected at one end to the base. A first cutting edge is located on the base and an opening is provided in the actuator to allow the nail of a finger of a hand pressing down on the actuator to be placed over the first cutting edge. A second cutting edge movable with the actuator towards the first cutting edge is used to trim the nail resting on the first cutting blade when the actuator is depressed.

What is needed is a fingernail and toenail clipper holding device that solves the limitations of the existing devices and provides a device that enables a user to more easily grip and use the nail clippers.

BRIEF SUMMARY OF THE INVENTION

An object of the present invention is to provide a fingernail and toenail clipper holding device that solves the limitations of the existing devices and provides a device that enables a user to more easily grip and use the nail clippers.

Another object of this invention is to provide a fingernail clipper holding device, as aforesaid, that secures fingernail clippers of variable sizes.

Still another object of this invention is to provide a fingernail clipper holding device, as aforesaid, having an enlarged housing that may be gripped securely by a user.

Yet another object of this invention is to provide a fingernail clipper holding device, as aforesaid, that includes an auxiliary finger gripping loop attached to the housing.

A further object of this invention is to provide a fingernail clipper holding device, as aforesaid, that may be held in a user's hand or positioned on a flat surface.

A still further object of this invention is to provide a fingernail clipper holding device, as aforesaid, that collects fingernail clippings within a hollow housing.

A particular object of this invention is to a fingernail clipper holding device, as aforesaid, that is easy to use and economical to produce.

In brief, a fingernail clipper holding device includes a housing having a hollow interior and having a generally ellipsoid configuration that is easy to grip. An upper portion of the housing may include a channel having a configuration suitable to receive the housing of a fingernail clipping device and to hold it securely. The housing defines a receiving area on which a user may position his finger adjacent the cutting head of the fingernail clipping device. A gripping member is attached to a lower portion of the housing to receive a user's fingers or hand. Stabilizing members may be attached to the bottom surface of the lower portion to hold the housing stationary on a flat surface.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
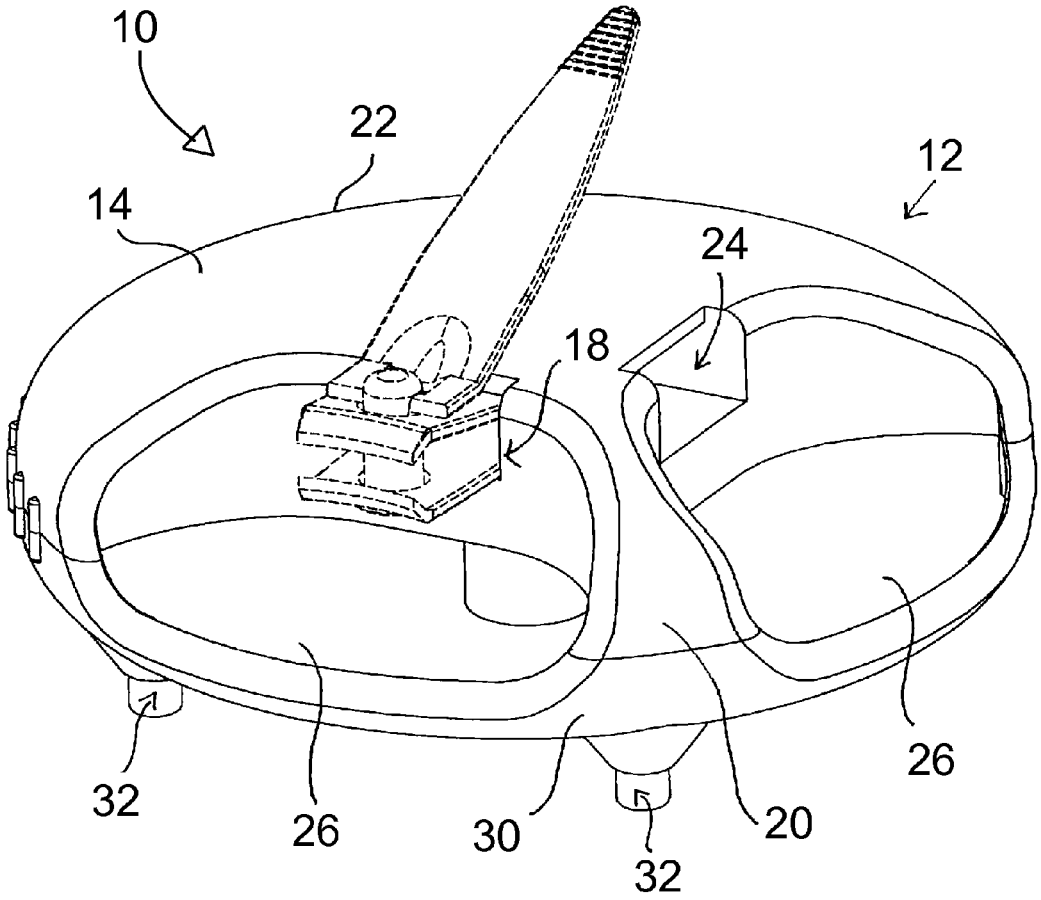
FIG. 1 is a perspective view of a fingernail cutter holding device according to an embodiment of the present invention having two channels for holding different sizes of nail clippers showing a nail file in one of the channels.

In FIGS. 1-9, a nail clipper holding device 10 comprises a nail clipper housing 12 comprising an outer shell structured in a generally ellipsoid configuration for gripping by a hand of a user. The housing having at least one radial channel 15 (18 and 24) extending into the housing configured to receive and secure a nail clipper 70 therein to hold the nail clipper with the nail clipping head facing outwardly spaced away from an outer perimeter of the housing and having a lever arm 71 of the nail clipper extending upwardly for activating the nail clipper by the user.

A receiving opening adjacent to the at least one radial channel is defined by a vertical wall 19 extending from the at least one radial channel 18 outwardly to receive a nail bearing digit of a user therein to position a nail for cutting adjacent to the cutting head 72 of the nail clipping device 70 for clipping the nail of the user.

A finger receiving area 26 and support deck 26A are provided in the receiving opening adjacent to the at least one radial channel and the nail clipper head 72 to support and steady the nail bearing digit of the user to be clipped.

Figure 4:
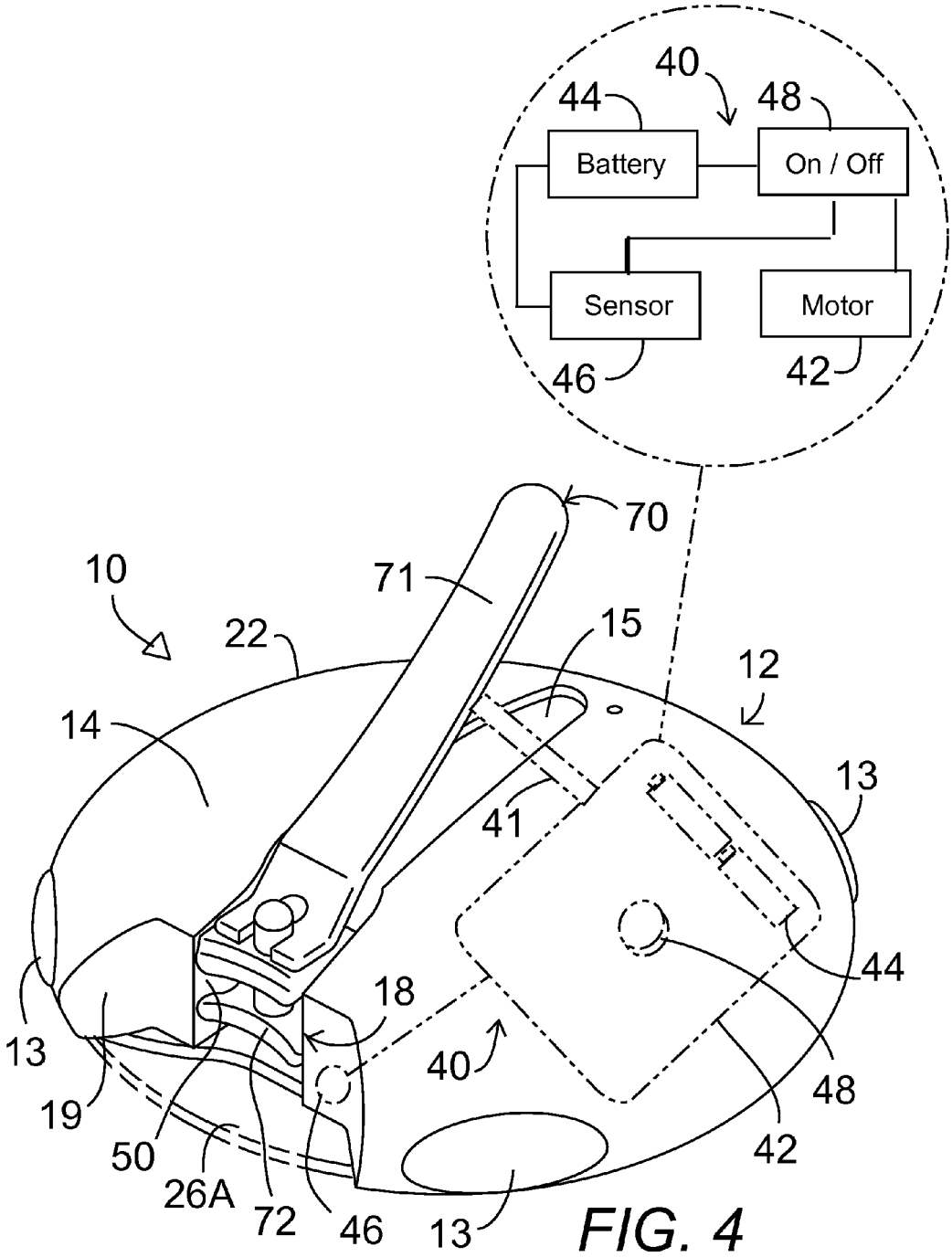
FIG. 4 is a perspective view of a fingernail cutter holding device of the present invention having an automated means for operating the nail cutter showing a motor, batteries, sensing device, control button, and operational arm for operating the nail clipper and a block diagram of the electronic components of the automated means.
Figure 5:
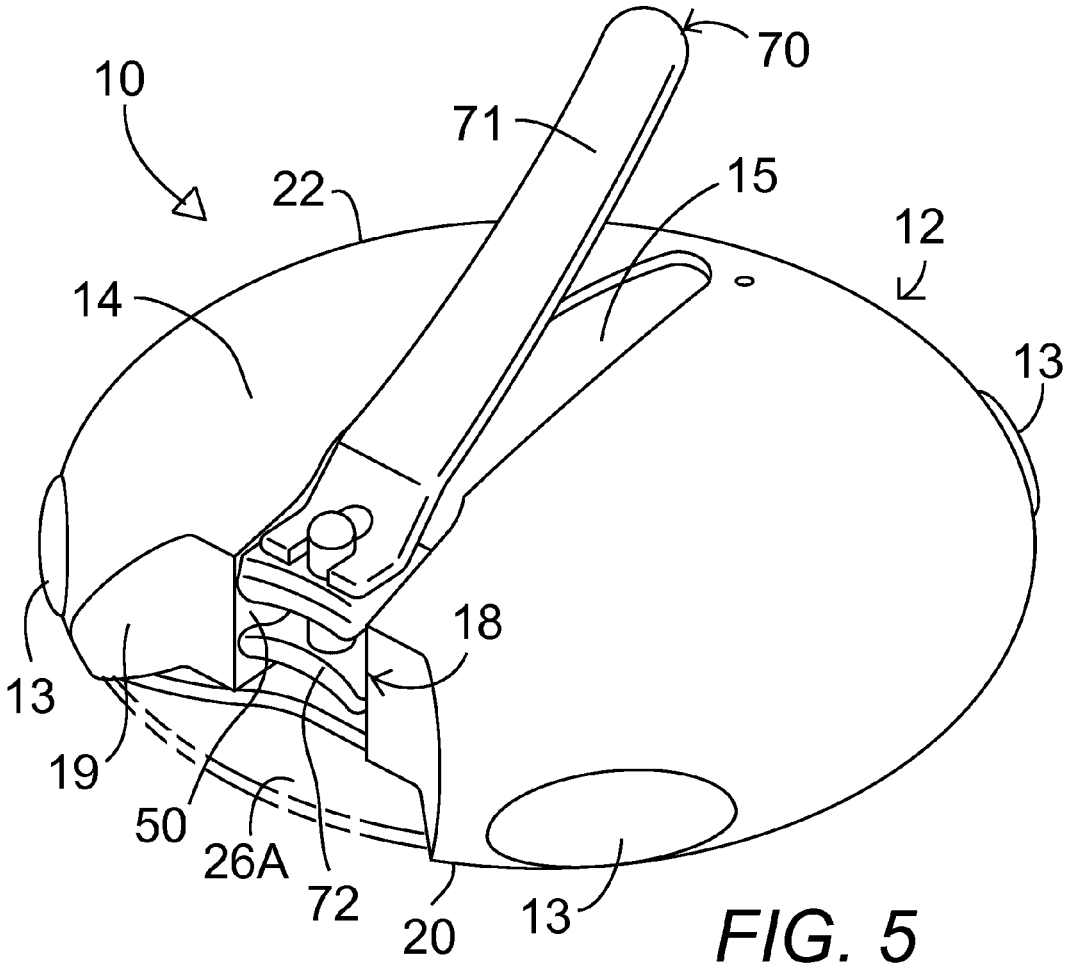
FIG. 5 is a perspective view of a preferred embodiment of the fingernail cutter holding device of the present invention showing the pivotable finger rest and the recessed head of the nail clippers for safety and for dispensing the nail clippings inside the housing.
Figure 6A:
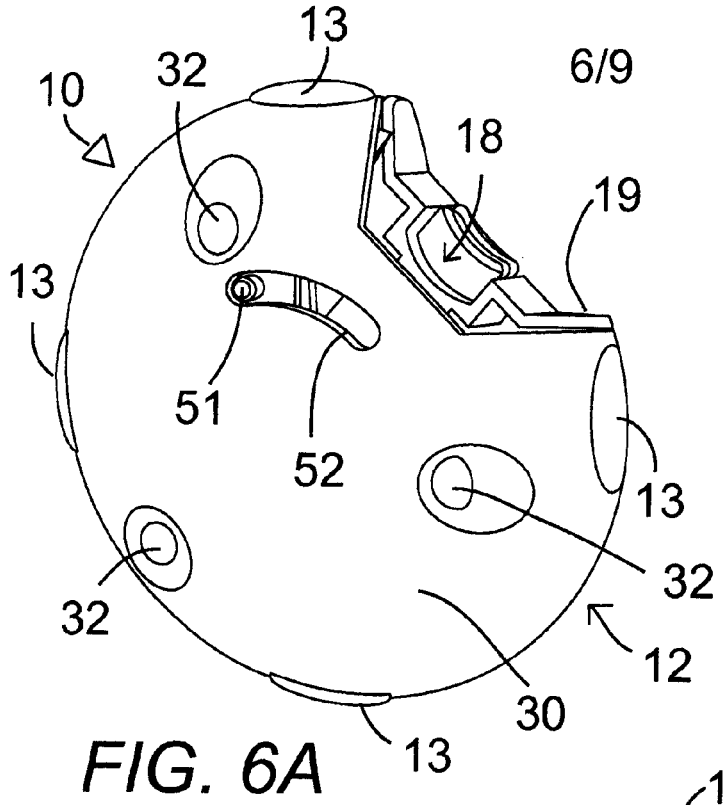
FIG. 6A is a bottom perspective view of the preferred embodiment of the fingernail clipper holding device of FIG. 5 showing the three bottom supports and the curved groove and knob for pivoting the finger support into and out of the housing.
Figure 6B:
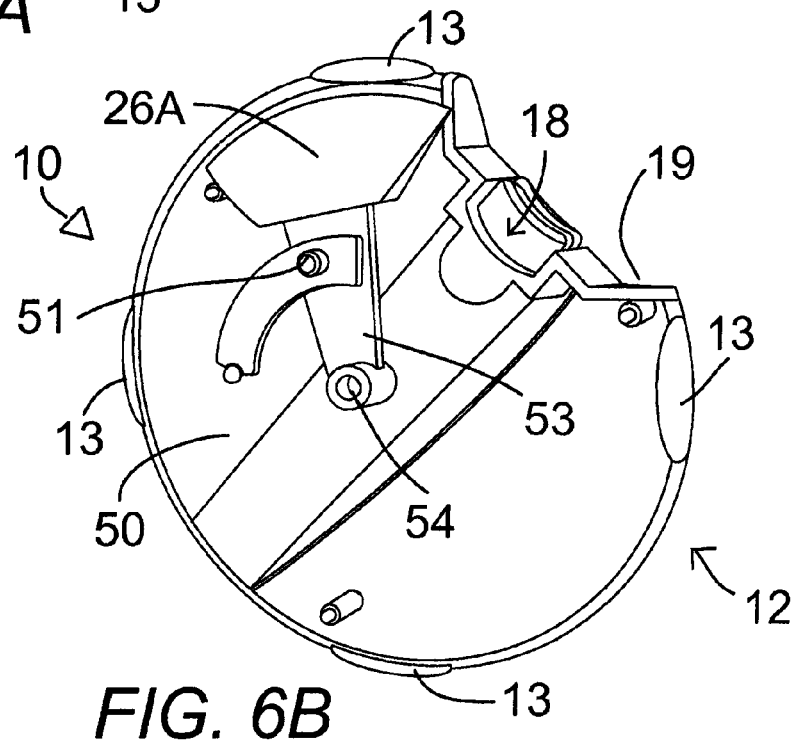
FIG. 6B is a bottom perspective view of the preferred embodiment of the fingernail clipper holding device of FIG. 5 with the bottom of the housing removed to show the finger support inside the housing and the pivot arm for pivoting the finger support into and out of the housing.

In FIGS. 4-9, the support deck 26A comprises a pivotable platform pivotable between a first position in the receiving opening adjacent to the receiving opening vertical wall 19 to support a nail bearing digit of the user, as shown in FIGS. 4, 5, 8, and 9, and a second position inside the housing, as shown in FIG. 6B by means of manipulation of knob 51 disposed in curved groove 52 and which is attached to pivot arm 53. Pivot arm 53 and attached support deck 26A are pivotable about pivot 54 secured to housing 12.

The recessed nail clipper head 72, as shown in FIGS. 4, 5, 6A and 6B, 7, and 8, provides greater safety for a user by retaining the sharp edges of the clipper head 72 in alignment with the receiving opening vertical wall 19 and by limiting the degree of clipping and further provides a release of the clippings into the housing through the open clipping receiving space 50 on the sides of the clipper head.

Figure 5A:
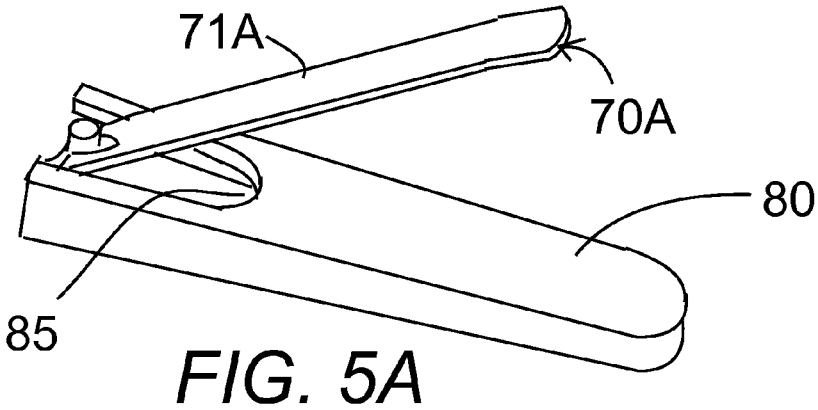
FIG. 5A is a perspective view of a smaller fingernail clipper than that of FIG. 5 inserted in an enlarging sleeve so that the smaller clipper can be used in the same channel on the fingernail clipper holding device of FIG. 5.

In FIG. 5A, a smaller fingernail clipper 70A with a smaller lever arm 71A than that of FIG. 5 is inserted in an enlarging sleeve 80 having a fingernail clipper receiving opening 85 so that the smaller clipper 70A can be used in the same channel 15 as the larger nailclipper 70 on the fingernail clipper holding device 10 of FIG. 5.

In FIG. 4, a movement generating device 40 inside the housing may automatically operate the nail clipper. A solenoid of a motor 42 or other movement generating device may be positioned in the interior area of the housing 12 and operatively coupled to an actuation arm 41 that extends above the upper portion 14 of the housing 12. When actuated, the actuation arm 41 is configured to engage with the operation arm 71 of the fingernail clipper when it is nested in a channel 15 of the housing 12 and, as a result, a fingernail of a person may be cut. In addition, a sensor 46 may be positioned on the finger receiving area 26 and adjacent to the cutting head 72 of the fingernail clipper such that the actuation arm will not operate unless a person's finger is appropriately positioned relative to the cutting head. In this respect, the cutting of a fingernail may require a two step process. First, the sensor 46 must detect that a person's finger is properly positioned relative to the cutting head and then the motor 42 must be activated to operate the actuation arm. The holding device 40 may be powered by a battery 44 and activated by an on/off switch or button 48.

The relatively wide housing 12 further comprises stabilizing members 32 attached to a bottom surface of the housing to maintain the housing stationary on a flat surface, as shown in FIG. 6A.

Figure 7:
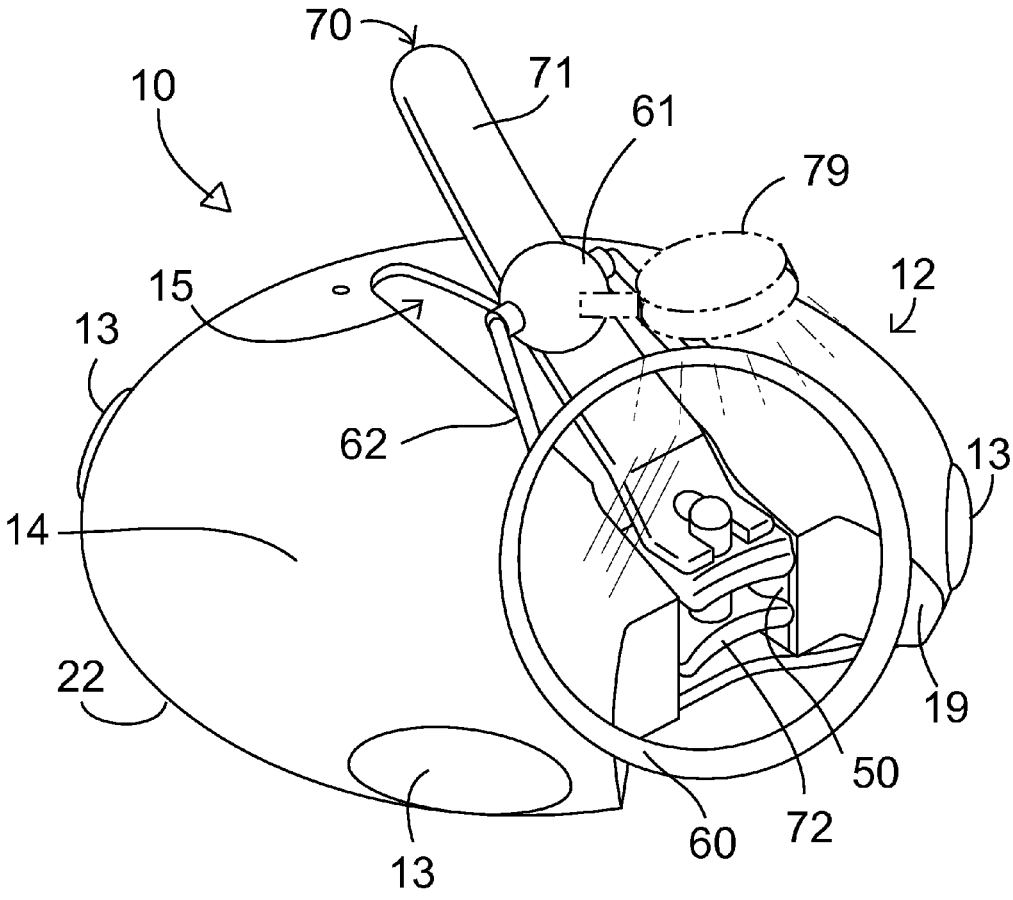
FIG. 7 is a perspective view of the preferred embodiment of the fingernail cutter holding device of FIG. 5 further comprising a magnifying glass and an optional light pivotally attached to the handle of the fingernail clipper for optional use with the nail clipper to better view the process of nail clipping.

In FIG. 7, a magnifying glass 60 is pivotally attached to by a pivot member 61 and pivot arms 62 to the lever arm handle 70 of the nail clippers or to a portion of the housing adjacent to the nail clipping head for magnifying the clipping action for more precise clipping and use by the visually impaired. The device may further comprise a light on the magnifying glass for illuminating a nail clipping action or a separate light 79 attached to the nail clipper lever arm 71 or to the housing adjacent to the nail clipping head for illuminating the clipping action.

Figure 8:
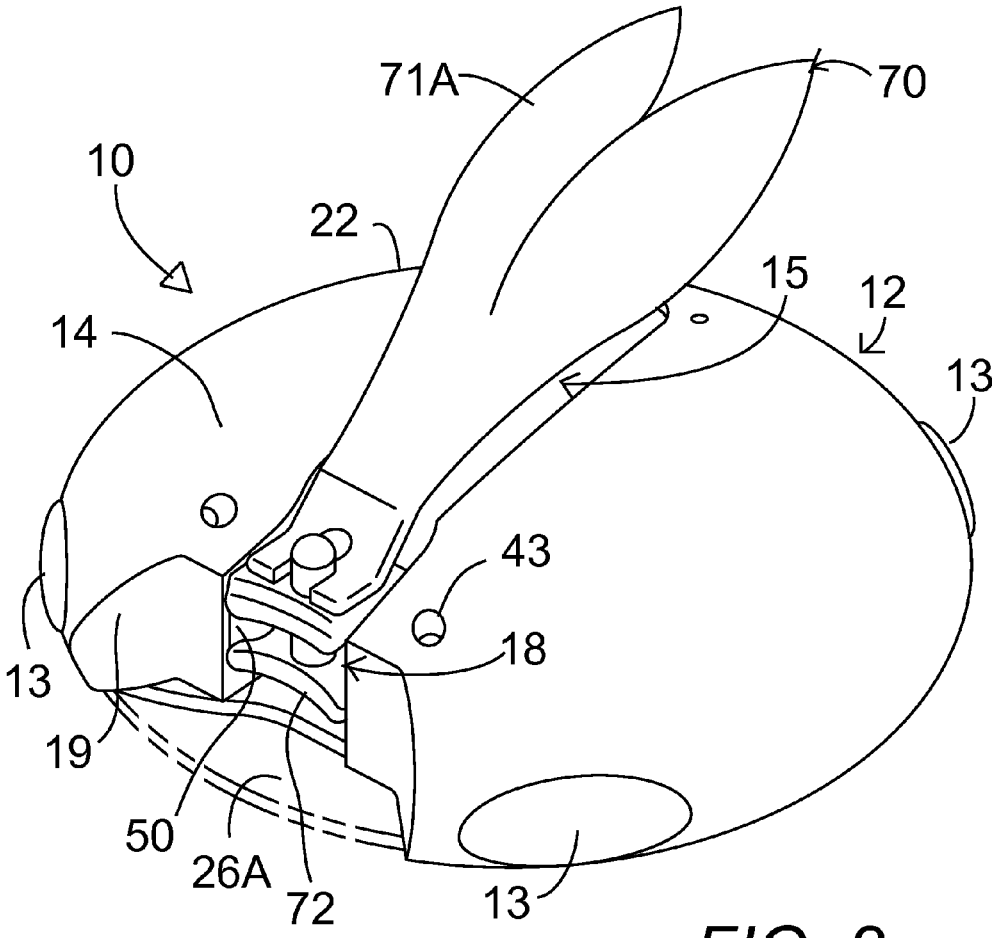
FIG. 8 is a perspective view of the preferred embodiment of the fingernail cutter holding device of FIG. 5 further showing simulated rabbit ears mounted on the handle of the nail clipper and simulated rabbit eyes mounted on the housing.
Figure 9:
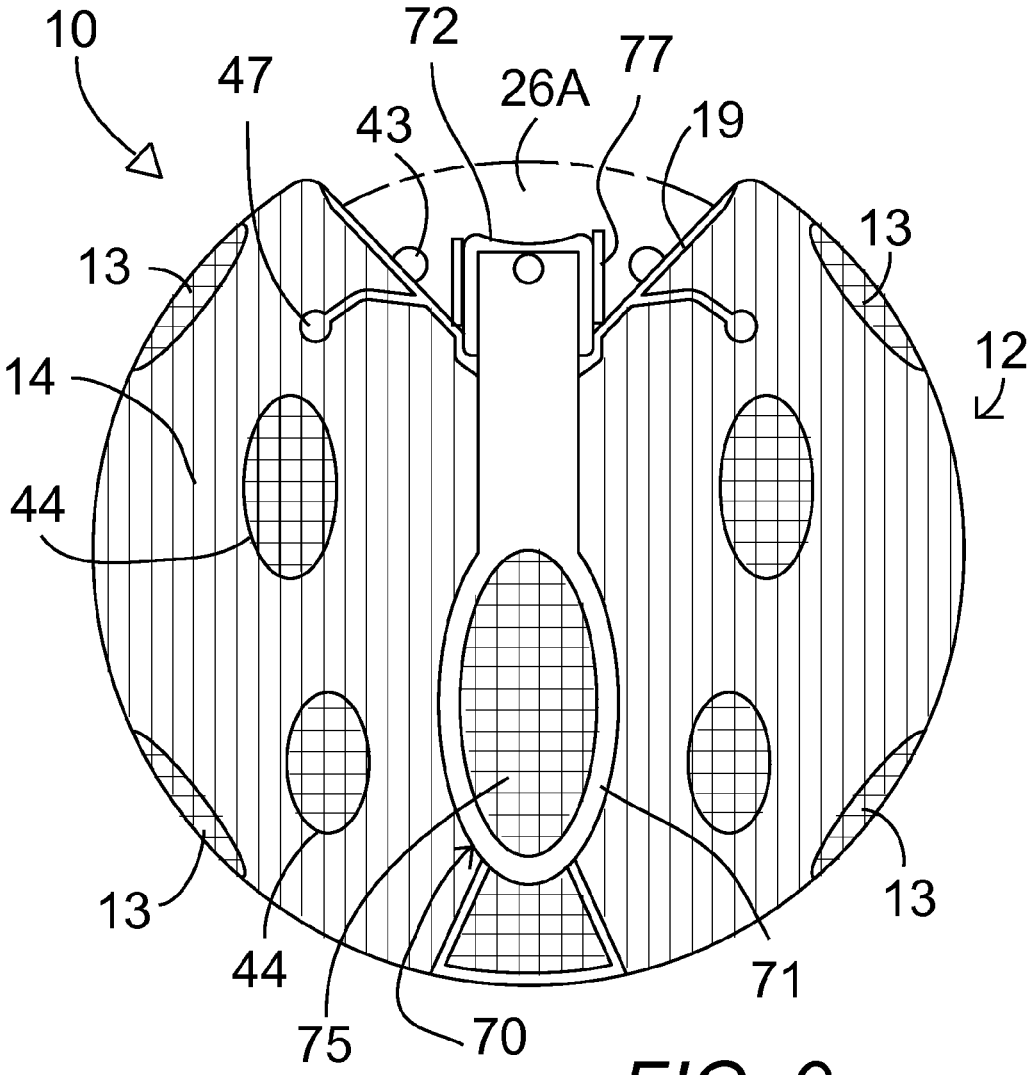
FIG. 9 is a perspective view of an alternate embodiment of the fingernail cutter holding device of the present invention having a protruding cutting head with side walls on the cutting head for retaining the nail clippings so that they fall back into the housing, a soft pad on the nail clipper handle shaped and colored to simulate a lady bug black spot and further showing a simulated red and black lady bug housing having black spots on a red housing, simulated lady bug antennae, and LED simulated lady bug eyes mounted in front.

A resilient non-slip pad 75 attached to the lever arm 70, as shown in FIG. 9, assists the user to apply even pressure on the lever arm with no slippage. Resilient non-slip pads 13 attached to an outer surface of the housing 12, as shown in FIGS. 4-9, assist the user in gripping and holding the housing securely during use.

In FIGS. 8 and 9, elements 43 and 47 are attached to the lever arm and housing to visually transform the device to resemble a creature to appeal to children to encourage use by children.

In FIG. 8, simulated rabbit ears 71A are mounted on the handle of the nail clipper and simulated rabbit eyes 43 mounted on or built into the housing 12.

In FIG. 9, a protruding cutting head 72 of the nail clipper 70 has side walls 77 on the cutting head for retaining the nail clippings so that they fall back into the housing. A soft pad 75 on the nail clipper lever arm 71 allows the user to apply even pressure on the lever arm with no slippage. In this embodiment, the soft pad 75 is shaped and colored black to simulate a lady bug black spot and the simulation further comprises a simulated red and black lady bug housing having black spots 44 on a red housing, simulated lady bug antennae 47, and LED simulated lady bug eyes 43 in front.

Figure 2:
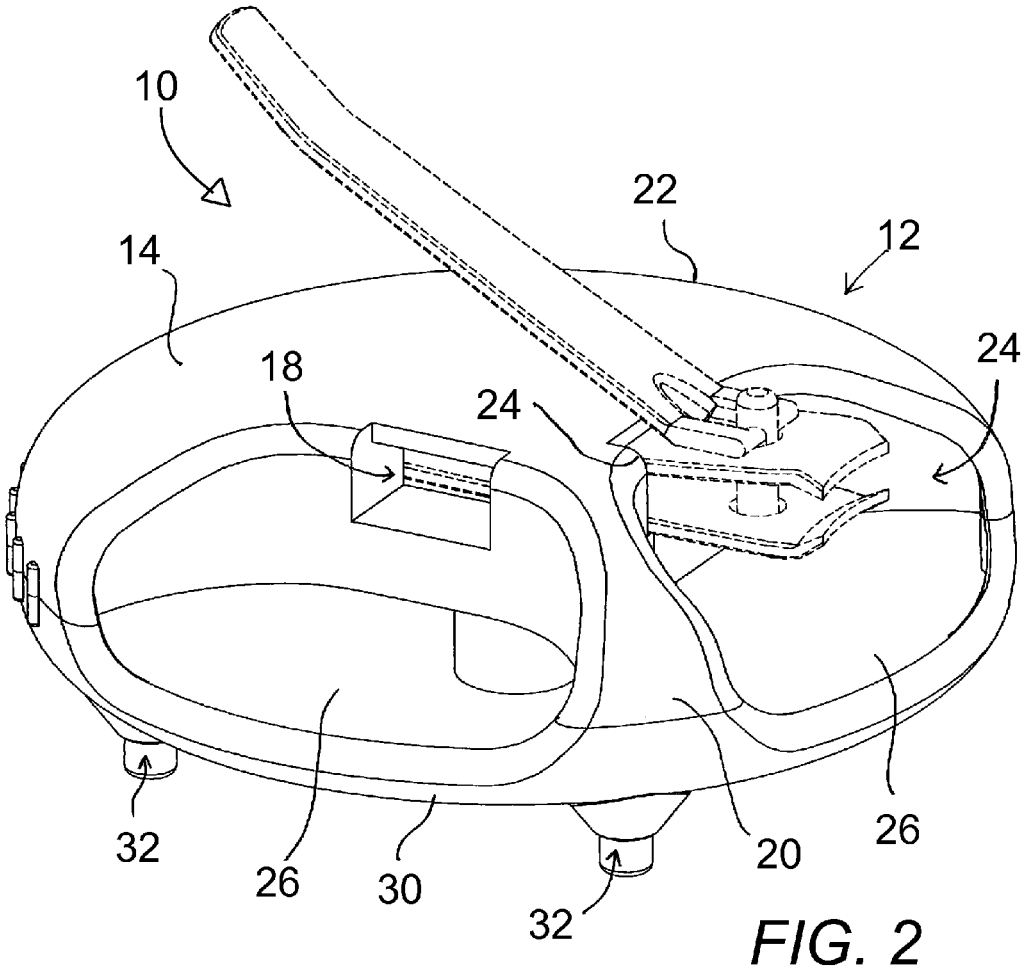
FIG. 2 is a perspective view of a fingernail cutter holding device of FIG. 1 having two channels for holding different sizes of nail clippers showing a differently sized nail file in the other of the channels.
Figure 3:
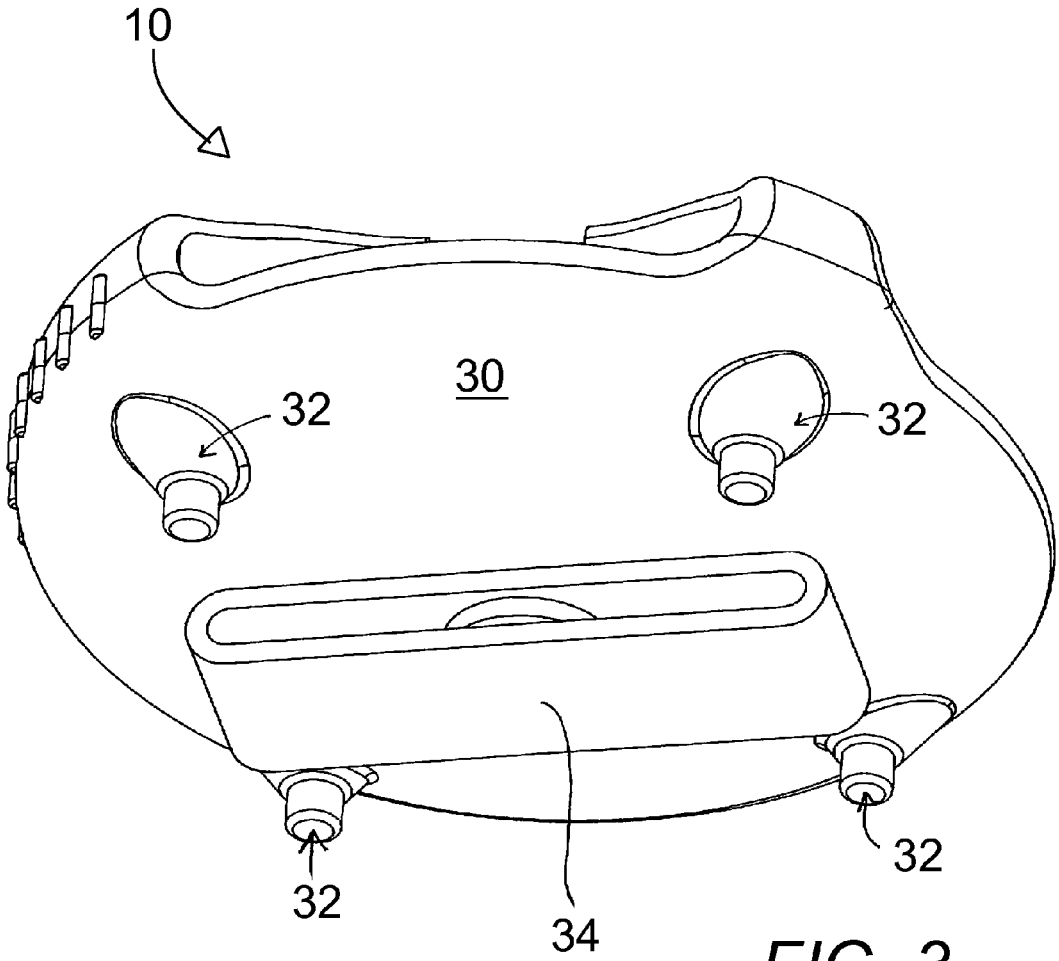
FIG. 3 a bottom view of a fingernail cutter holding device of FIG. 1 showing the gripping handle and the stabilizing support feet.

In FIGS. 1-3, an alternate embodiment of the fingernail clipper holding device 10 includes a base or housing 12, a gripping member 34, and a finger receiving area 26.

Preferably, the housing 12 includes a three dimensional oval or generally ellipsoid configuration having a texture that is easy for a user to grip and hold in his hand. The outer surface of the b-a se may include a non-slip rubber, urethane, or plastic surface for enhanced grip. The housing 12 may define a hollow interior for holding fingernail clippings. An upper portion 14 of the housing 12 has a first channel 18 extending substantially between front 20 and rear 22 ends thereof, one end of the first channel 18 being open. The first channel 18 includes a configuration that is complementary to a configuration of a fingernail clipper housing member so as to receive it therein in a friction fit relationship. The housing 12 may define a second channel 24 having a construction substantially similar to the channel 18 described above but having a smaller dimension so as to receive a finger clipper base of smaller dimension in a secure friction fit relationship. Preferably, the second channel 24 is positioned perpendicular to the first channel 18.

The upper portion 14 of the housing 12 defines the finger receiving area 26 adjacent the channel open end. The receiving area 26 includes a configuration that is suitable for nesting a user's finger adjacent the cutting head of a fingernail clipper device secured in the channel 18. Preferably, the finger receiving area 26 may be recessed more (i.e. deeper/lower) than the clipper receiving area such that a user's fingernail is positioned appropriately to be cut by the cutting head of the clipper device. The finger receiving area 26 enables a finger to be held more steadily while cutting a respective fingernail successfully. In addition, the finger receiving area 26 may define an aperture connecting the interior area with an area outside the housing 12, wherewith to receive cut fingernails into the interior area.

Further, the fingernail clipper holding device 10 may include a gripping member 34 (which may also be referred to herein as an auxiliary gripping loop) removably attached to a lower portion 30 of the housing 12 (FIG. 3). The gripping member 34 may include one or more circular openings having dimensions complementary to those of a person's fingers so as to receive respective fingers therethrough. Alternatively, the gripping member 34 may define a single opening configured to receive a person's hand therethrough so as to hold the housing 12. The gripping member 34 may be constructed of an elastic material although other suitable fabric may also be used.

In addition, the fingernail clipper holding device 10 may include one or more stabilizer members 32 attached to the lower portion 30 of the housing 12. Each stabilizer member 32 may be a suction cup, rubber foot, or the like such that the housing 12 may be held at a desired position upon a flat surface.

In use, the housing member of a fingernail clipper device may be inserted into an appropriate channel 18, 24 of the housing 12. The housing 12 itself may be held by a user, either by the lower portion 30 or by inserting a hand or fingers into the gripping member 34. Then, a respective one of the user's fingers may be positioned upon the finger receiving area 26 adjacent the cutting head of the nail cutting device. When a user's finger nail is positioned with the cutting head (i.e. between cutting blades), the fingernail cutting device may be manually actuated to cut the fingernail, the cut fingernail being automatically deposited through the aperture into the interior area of the housing 12.

It is understood that the preceding description is given merely by way of illustration and not in limitation of the invention and that various modifications may be made thereto without departing from the spirit of the invention as claimed.

What is claimed is:

1. A nail clipper holding device for receiving a nail clipper comprising:

a nail clipper, a nail clipper housing comprising an outer shell structured in a generally ellipsoid configuration for gripping by a hand of a user; at least one radial channel extending into the housing configured to receive and secure said nail clipper therein to hold the nail clipper having a nail clipping head facing outwardly and spaced away from an outer perimeter of the housing and having a lever arm of the nail clipper extending upwardly for activating the nail clipper by the user; a receiving opening vertical wall adjacent to the at least one radial channel and extending from the at least one radial channel outwardly to receive a nail bearing digit of a user therein to position a nail for cutting adjacent to the cutting head of the nail clipping device for cutting the nail of the user; a support deck adjacent to the at least one radial channel and the nail clipper head to support and steady the nail bearing digit of the user to be clipped, the support deck comprising a pivotable planar platform pivotable between a first position in the receiving opening to support a nail bearing digit of the user and a second position inside the housing; and said platform pivotable in a plane coincidental with said planar platform.

2. The device of claim 1 further comprising the nail clipping head being recessed into alignment with the receiving opening vertical wall to provide greater safety for a user by retaining the sharp end edges of the clipper head in alignment with the receiving opening vertical wall, to limit the degree of clipping, and to provide release of the nail clippings into the housing through the open clipping receiving space on the sides of the clipper head.

3. The device of claim 1 further comprising a grasping loop on an underside of the housing to hold the housing securely.

4. The device of claim 1 further comprising stabilizing members attached to a bottom surface of the housing to maintain the housing stationary on a flat surface.

5. The device of claim 1 further comprising a magnifying glass pivotally attached to said lever arm adjacent to the nail clipping head for magnifying a clipping action.

6. The device of claim 5 further comprising a light on the magnifying glass for illuminating a nail clipping action.

7. The device of claim 1 further comprising a light attached to said lever arm adjacent to the nail clipping head for illuminating a clipping action.

8. The device of claim 1 further comprising at least one resilient non-slip pad attached to the lever arm to allow the user to apply even pressure on the lever arm with no slippage.

9. The device of claim 1 further comprising at least one resilient non-slip pad attached to an outer surface of the housing to assist the user in gripping and holding the housing securely during use.

10. The device of claim 1 further comprising a nail clipper enlarging sleeve to receive a smaller nail clipper device and said enlarging sleeve adapted for insertion into said radial channel.

11. The device of claim 1 further comprising at least one visual element attached to the lever arm and housing to visually transform the device to resemble a creature to appeal to children to encourage use by children.

12. The device of claim 1 further comprising a movement generating device inside the housing for operating the nail clipper.

13. The device of claim 1 wherein a pivot is secured to said housing and pivot arm having two ends is secured at one end to said pivot and at the other end to said support deck.

14. The device of claim 13 wherein a curved groove is formed in said housing and a knob is secured to said pivot arm and extends through said curved groove.

* * * * *